US005393048A

United States Patent [19]

Rodriguez-Ferre

[11] Patent Number: 5,393,048

[45] Date of Patent: Feb. 28, 1995

[54] CHILD'S BASKETBALL GAME

[76] Inventor: José M. Rodriguez-Ferre, Polig. Industrial Derramador, Albacete s/n - 03440-IBI (Alicante), Spain

[21] Appl. No.: 158,983

[22] Filed: Nov. 30, 1993

[51] Int. Cl.[6] ..... A63B 63/08

[52] U.S. Cl. ..... 273/1.5 R

[58] Field of Search ..... 273/1.5 R, 1.5 A

[56] References Cited

U.S. PATENT DOCUMENTS 3,669,450 6/1972 Mason ..... 273/1.5 R
3,716,234 2/1973 Lancellotti ..... 273/1.5 R
5,082,261 1/1992 Pelfrey ..... 273/1.5 R

*Primary Examiner*—William H. Grieb
*Attorney, Agent, or Firm*—Birch, Stewart, Kolasch & Birch

[57] ABSTRACT

A child's basketball game includes a ballasted base to which there is attached a telescopic column formed by two sections, the upper one of which supports the ring carrying the net and board. The column is fixed with a trapezial support. The unit is easy to dismantle for storage in a small space. The game is for children and the height is adjustable depending on the size thereof.

7 Claims, 2 Drawing Sheets

Fig. 3
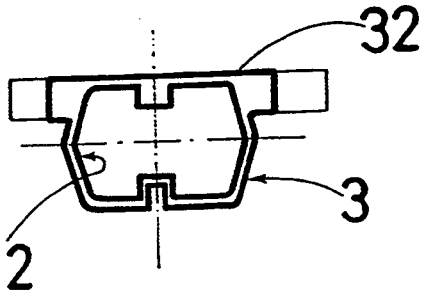
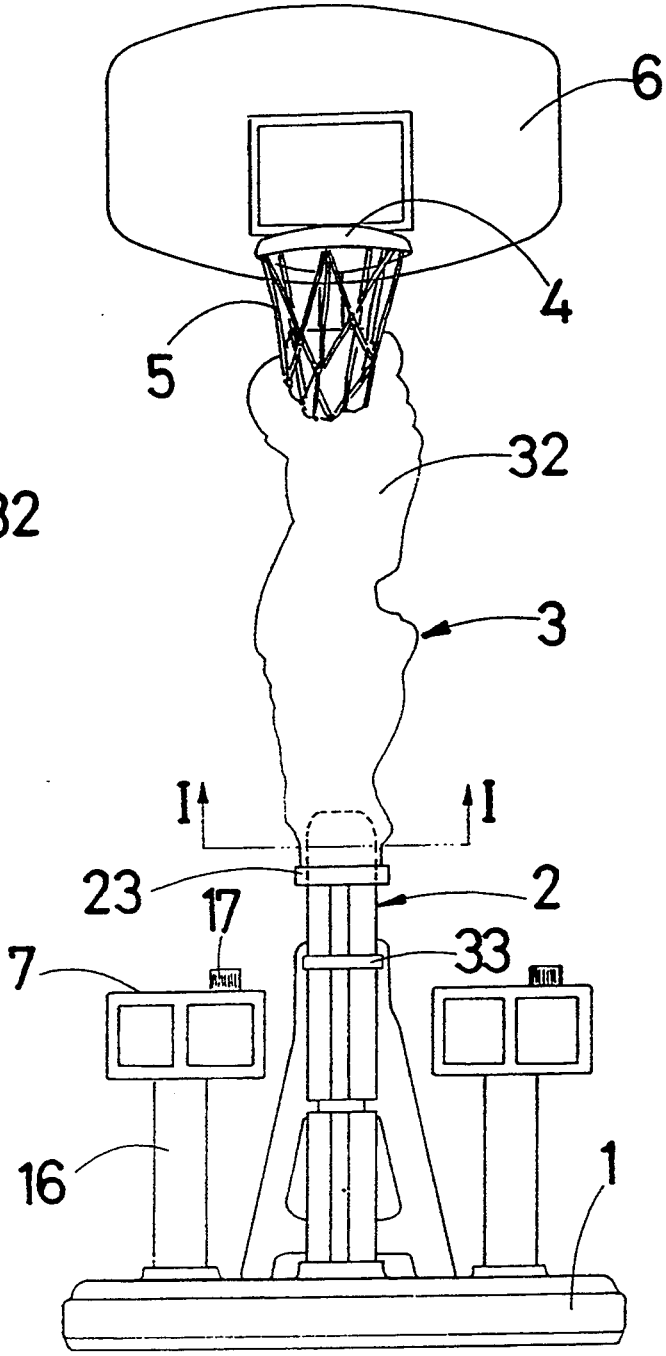
Fig. 4

CHILD'S BASKETBALL GAME

BACKGROUND OF THE INVENTION

This invention relates to a child's basketball game.

SUMMARY OF THE INVENTION

In the invention there has been devised a basketball game for children over three years of age, the game comprising various parts of molded material which when duly associated together constitute the support for the board and basket for playing basketball.

The support is adjustable to adapt it to the size of the children. The various component parts, after the game has been dismantled, may be stored away in a small space. Assembly is extremely simple and may be carried out by the child himself without needing tools or other accessories. The component parts of elements of the game are made from molded material, are light in weight and easy to handle, since they are hollow items.

Generally speaking, the game is constituted by an adjustable height telescopic column which is attached at the top end to the ring carrying the net itself, said ring including means for attachment to the board; at the lower end the support is attached to a base and it is supported by a trapezial shaped member. The base is provided with housings for attachment of two scoreboards.

Thus, the resulting unit reproduces on a smaller scale a basketball net of the type supported by a structure in the form of a column or stay, to be installed preferably outdoors, without requiring an excessive space or area for playing the sport and the component parts being easy to dismantle for storage in a small space.

BRIEF DESCRIPTION OF THE DRAWINGS

To facilitate the explanation, the present description is accompanied by sheets of drawings in which there is illustrated one embodiment given as an example. In the drawings:

FIG. 3 is a cross section view on the line I—I of the telescopic column;

FIG. 4 is a front elevation view of the fully mounted game.

DETAILED DESCRIPTION OF THE PREFERRED EMBODIMENTS

Figure 1:
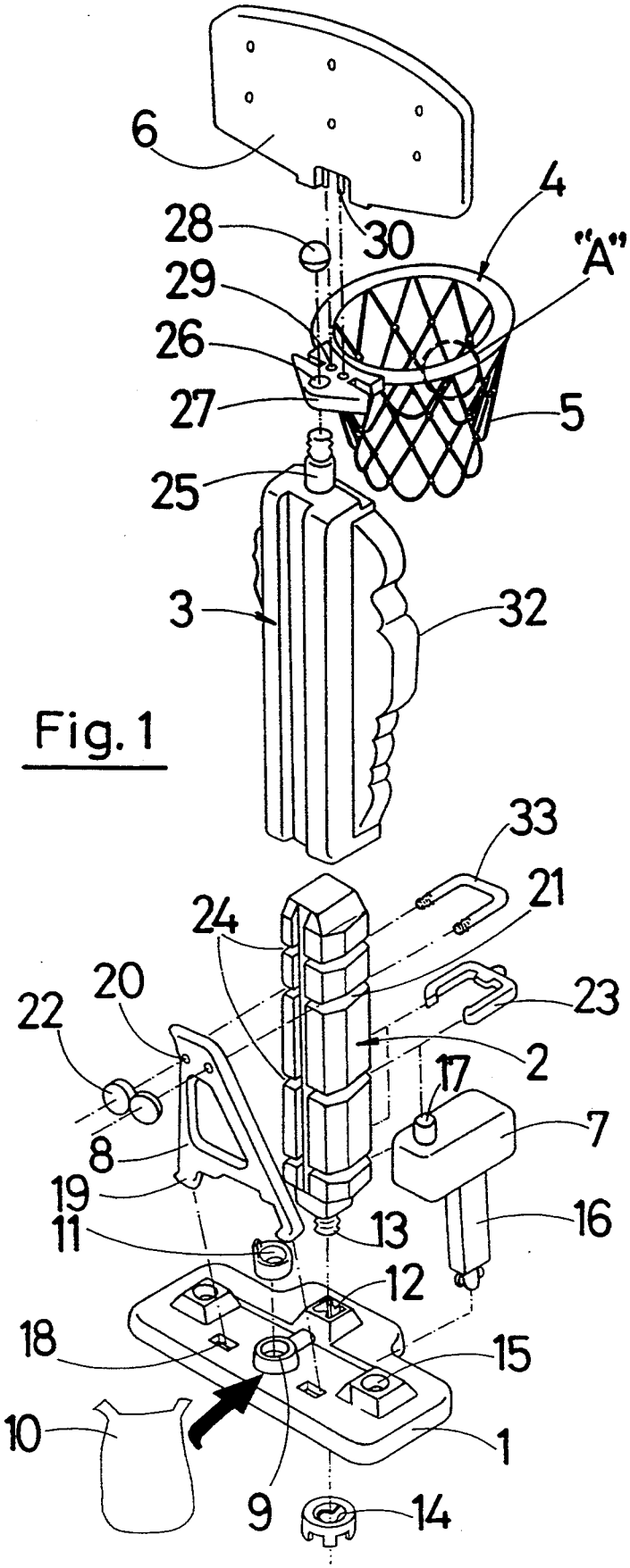
FIG. 1 is an exploded perspective view of the game of the invention.
Figure 2:
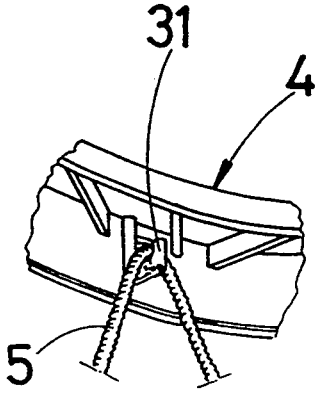
FIG. 2 is a view of the detail "A" showing how the net is attached.

With reference to the Figures, there is to be seen a basketball game constituted by the parts listed hereafter:

A base 1;

A telescopic column formed by parts 2 and 3;

A ring 4, with means for attachment of the net 5 and board 6;

Two scoreboards 7 for counting the baskets scored by the players; and

A support 8 for the telescopic column.

The base 1 is hollow and forms a flattened rectangle, to provide a large support base, having a hole 9 communicating with the interior for ballasting with sand or the like from the bag 10. The hole 9 is closed with a stopper 11. A through hole 12 is provided in the base for receiving a threaded axial pin 13 of the lower part 2 of the column, which is locked with a nut 14. Further holes 15 receive the ends of supports 16 of respective prismatically shaped scoreboards having a rotary control 17 for operating the numbers. Finally, slots 18 act as anchorage for tabs 19 of the trapezial support 8, provided at the top thereof with holes 20 for the threaded ends of a U-shaped clamp 33 which is housed in the slot 21 of the column 2 and which is locked in place by nuts 22.

Along the column 2 there telescopically slides the other part 3 of the column, both having a partly equivalent cross section, as shown in FIG. 3, to facilitate the axial movements to obtain different heights which are set with a U-shaped stop member 23 housed in one of the slots 24 of the part 2.

The part 3 of the column is provided with an axial pin 25 having a screw thread. The pin 25 is inserted in the hole 26 of an expansion 27, external to the ring 4, and the threaded portion of the pin 25 receives a lock nut 28. The expansion 27 is provided with holes 29 for receiving the pins 30 of the board 6. The ring 4 is resilient, allowing it to be deformed when netting, and includes on the inside thereof hooks 31 formed in the molding operation and equidistantly arranged for holding the net 5. The part 3 of the upper part of the column has a widened flat front surface 32 for application of a covering sheet.

I claim:

1. A child's basketball game, comprising:

a base;

a telescopic column adjustable in height attached to said base, said telescopic column being formed by two sections including an upper section and a lower section attached directly to said base;

a backboard, a ring and a net formed on said ring all supported on the upper section of said telescopic column; and a support for supporting said column and at least one scoreboard.

2. The child's basketball game of claim 1, wherein said base is hollow, said base further comprising a hole communicating with the interior thereof for ballasting said base.

3. The child's basketball game of claim 1, further comprising a threaded axial pin formed on the lower section of the column and a hole formed in said base, said threaded axial pin being inserted in the hole of the base and fixed with a nut.

4. The child's basketball game of claim 1, wherein said support of the column is trapezium shaped, said support including hook-like lower extensions and upper holes, said base including slots formed therein and said game further comprising a nut-screwed clamp engageable with the column, wherein said hook-like extension of said support may be housed in the slots of said base and the threaded ends of said clamp are inserted in said upper holes and secured by nuts.

5. The child's basketball game of claim 1, wherein said lower section of the column is provided with horizontal slots at different levels and wherein said game further comprises a U-shaped member which when engaged in any one of said horizontal slots forms a support stop member for the upper section of the column, to obtain different column heights.

6. The child's basketball game of claim 1, wherein the ring is provided with an externally extending expansion having a through hole and wherein the upper section of the column is provided with an axial pin, to which axial pin there is screwed a ring lock nut wherein the through hole receives said axial pin, said board further including supporting pins and said expansion including holes for receiving the board supporting pins.

7. A child's basketball game comprising:

a base member having at least one receiving hole formed therein;

a telescopic column adjustable in height attached to said base, said telescopic column being formed of two sections including an upper section and a lower section with said lower section attached directly to said base;

a backboard, a ring and a net formed on said ring all supported on the upper section of said telescopic column; and a threaded axial pin formed on a lower end of said lower section, said threaded axial pin being inserted into said at least one receiving hole formed in said base member and fixed with a nut, wherein said ring is provided with an externally extending expansion having a through hole for an axial pin of the upper section of the column, to which pin there is screwed a ring lock nut, said expansion including holes for receiving pins for supporting said board.

* * * * *